US005703558A

United States Patent [19]

Wood

[11] Patent Number: 5,703,558

[45] Date of Patent: Dec. 30, 1997

[54] COMBINED TERMINAL BLOCK MOUNT AND LAMINATION STACK KEEPER

[75] Inventor: Daniel P. Wood, Laurel Hill, N.C.

[73] Assignee: Acme Electric Corporation, East Aurora, N.Y.

[21] Appl. No.: 401,939

[22] Filed: Mar. 10, 1995

[51] Int. Cl.[6] ..... H01F 27/29; H01F 27/30; H01F 27/26

[52] U.S. Cl. ..... 336/192; 336/196; 336/208; 336/210

[58] Field of Search ..... 336/192, 196, 336/199, 208, 234, 210

[56] References Cited

U.S. PATENT DOCUMENTS

| | | | |
|---|---|---|---|
| 3,474,371 | 10/1969 | Miller | 336/210 |
| 3,510,830 | 5/1970 | Wieland . | |
| 3,609,614 | 9/1971 | Schutz | 336/134 |
| 3,691,425 | 9/1972 | Weyrich et al. . | |
| 3,760,316 | 9/1973 | Czewski et al. | 336/210 |
| 4,283,699 | 8/1981 | Ehrgott et al. | 336/67 |
| 4,602,235 | 7/1986 | Howard et al. | 336/192 |
| 4,804,340 | 2/1989 | Hamer et al. . | |

*Primary Examiner*—Michael L. Gellner
*Assistant Examiner*—Daniel Chapik
*Attorney, Agent, or Firm*—Pearne, Gordon, McCoy & Granger LLP

[57] ABSTRACT

A combined terminal block mount and lamination stack keeper has a metal keeper with a flat first portion of a size and shape to lie contiguous to and oriented with a stack of laminations. A part of the stack of laminations is adapted to receive an inductance coil, and the coil is adjacent a part of the keeper first portion. There is a bend in the keeper to establish a unitary mounting strip out of the plane of the keeper first portion, and the mounting strip has a width and thickness to mount a terminal block thereon. The foregoing Abstract is merely a resume of general applications, it is not a complete discussion of all principles of operation or applications, and is not to be construed as a limitation on the scope of the claimed subject matter.

20 Claims, 2 Drawing Sheets

Fig.1
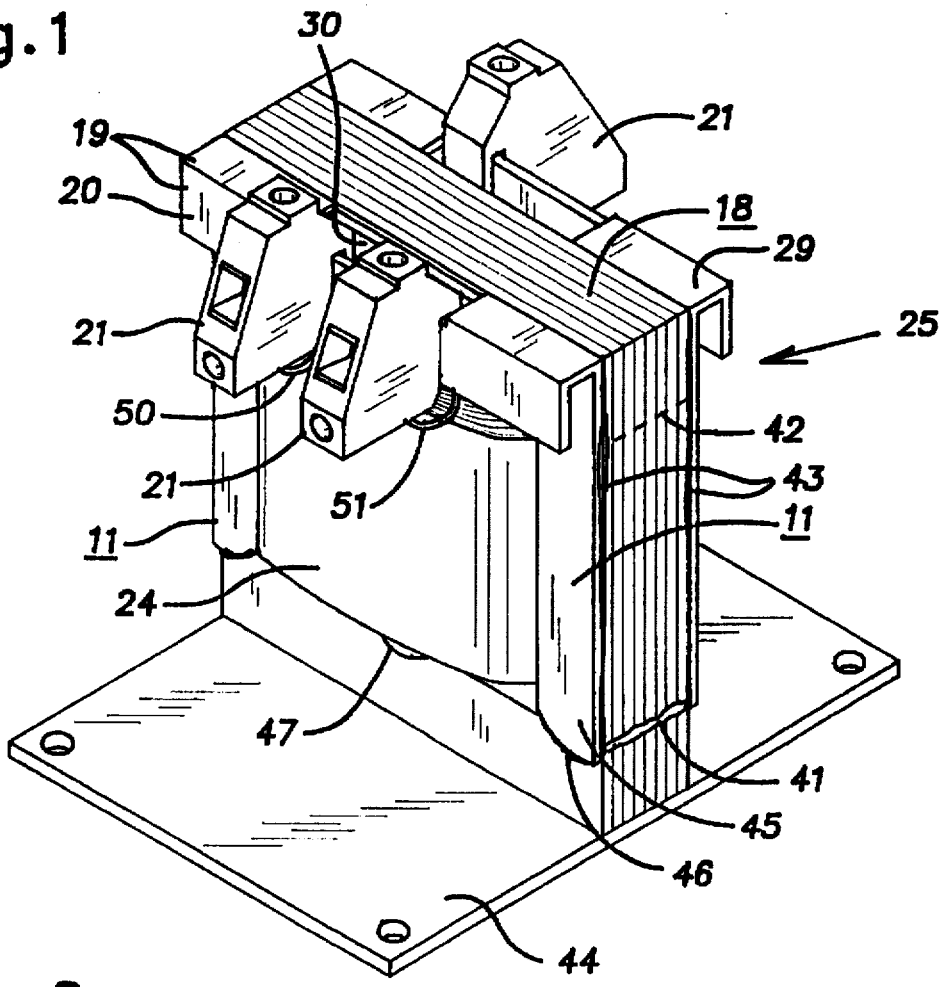
Fig.2
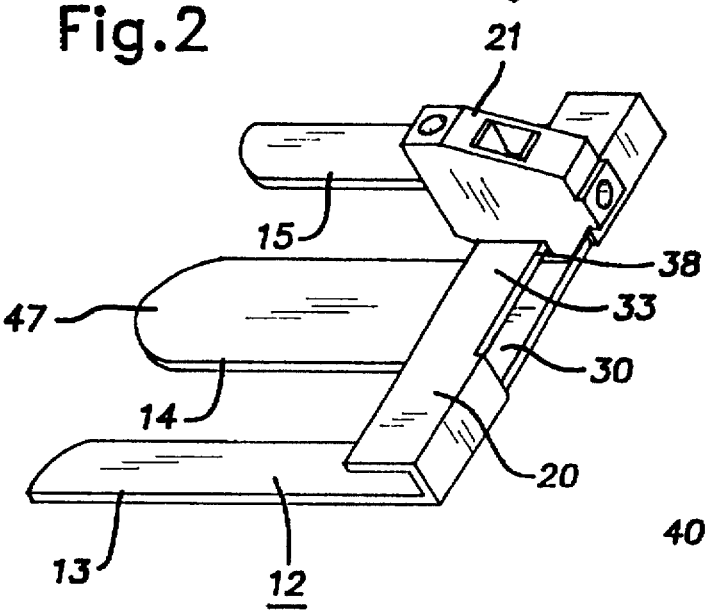
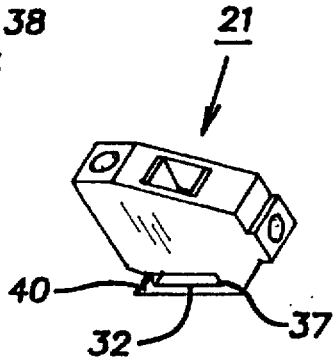
Fig.3

COMBINED TERMINAL BLOCK MOUNT AND LAMINATION STACK KEEPER

BACKGROUND OF THE INVENTION

Lamination stack keepers have been known to help align the laminations in a stack and to help secure them together. A separate mount attached by screws to the keeper has been known on which terminals for the electrical device may be mounted.

U.S. Pat. No. 3,510,830 shows a terminal block which may be slid on or snapped over a u-shaped mount. U.S. Pat. No. 4,602,235 discloses a mount for the terminals which is a friction fit between a transformer coil and core. U.S. Pat. No. 3,691,425 discloses a terminal mount with terminals mounted in a slot in the bobbin for a coil. U.S. Pat. No. 4,804,340 discloses a terminal block mounted on the coil of a transformer.

SUMMARY OF THE INVENTION

The invention relates to a combined terminal block mount and lamination stack keeper, comprising, in combination: a metal keeper having a flat first portion of a size and shape to lie contiguous to and oriented with a stack of laminations; means for securing said keeper first portion to said lamination stack; a part of said stack of laminations being adapted to receive an inductance coil with the coil adjacent a part of said keeper first portion; a bend in said keeper to establish a unitary mounting strip out of the plane of the keeper first portion; and said mounting strip having a width and thickness to mount a terminal block thereon.

A transformer, comprising, in combination: a stack of laminations; a combined terminal block mount and lamination keeper having a flat first portion of a metal keeper of a size and shape to lie contiguous to the stack of laminations: said metal keeper first portion having an arm unitary at one end with and perpendicular to a connecting strip; a transformer coil received on a part of said stack of laminations and on a part of said keeper first portion; a bend in a portion of said connecting strip to establish a mounting strip out of the plane of the first portion of said metal keeper; said mounting strip having a given width and thickness to mount a terminal block thereon; a terminal block having a cantilever arm mounted on said mounting strip; and a connection from said transformer coil to said terminal block.

An object of the invention is to provide a unitary terminal block mount and lamination stack keeper for minimization of parts and easy installation. The invention further is directed to a lamination keeper/terminal mount which is versatile in providing a mount for a different number of terminal blocks.

Other objects and a fuller understanding of the invention may be had by referring to the following description and claims, taken in conjunction with the accompanying drawing.

BRIEF DESCRIPTION OF THE DRAWINGS

FIG. 1 is an isometric view of the terminal mount/lamination stack keeper as assembled with a transformer;

FIG. 2 is an isometric view of the terminal mount/keeper with one terminal mounted thereon;

FIG. 3 is an isometric view of just one of the terminal blocks;

DESCRIPTION OF THE PREFERRED EMBODIMENT

Figure 4:
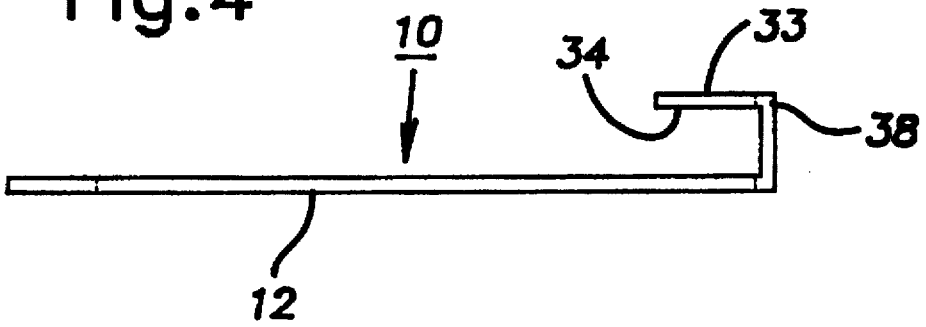
FIG. 4 is a side-view of the terminal mount/keeper.
Figure 5:
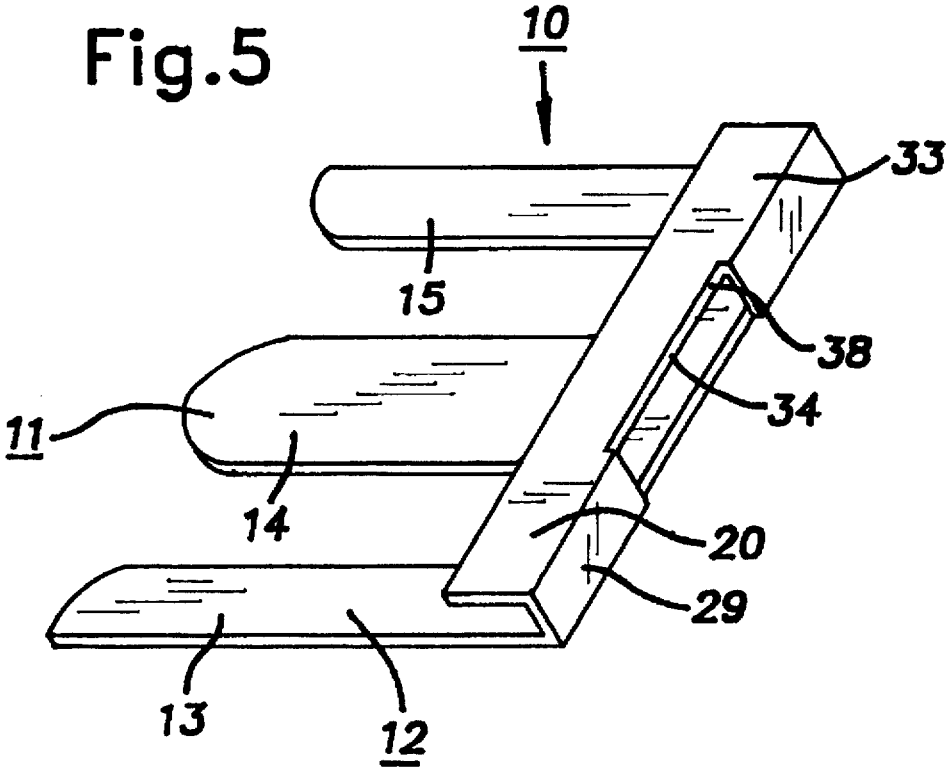
FIG. 5 is an isometric view of just the terminal mount/keeper.

A terminal mount/keeper 10 is shown in FIGS. 1, 2, 4 and 5. This combined terminal mount and lamination stack keeper 10 comprises a metal keeper 11 which has a flat first portion 12 of a size and shape to lie contiguous to and oriented with a stack of laminations 18. In this embodiment, this flat first portion 12 is E-shaped with first, second and third arms 13, 14 and 15, respectively. The second arm 14 is the middle arm of the E-shape. In this embodiment, the flat metal keeper first portion is nearly the same size and shape as the E-I lamination stack and lies contiguous to the stack 18. The metal keeper 11 has a second portion 19 which is generally perpendicular to the arms 13–15. This second portion includes a mounting strip 20 which may be used to mount terminal blocks 21.

A part of the stack of laminations 18 is adapted to receive an inductance coil 24, to make a transformer 25, with the coil adjacent a part of the keeper first portion 12 which in this case are the two outer arms 13 and 15. The coil 24 also envelops the second or middle arm 14. A first bend 26 in the keeper second portion 19 and then a second bend 19 establishes the mounting strip 20 out of the plane of the keeper first portion 12. In this preferred embodiment the mounting strip 20 is substantially parallel to the keeper first portion 12. The first bend 26 establishes a generally vertical portion 29 perpendicular to the keeper first portion 12. An aperture 30 is provided in this vertical portion 29, and this receives a cantilever leg 32 of a terminal block 21. The mounting strip 20 has a width and thickness on which to mount a terminal block 21. The mounting strip 21 has an upper support surface 33 and an opposite surface 34. The terminal block 21 has a lower surface 35 to sit on the upper support surface 33, and the cantilever leg 32 has an upper surface 36 adapted to engage the opposite surface 34 of this mounting strip 20.

An edge 38 of the aperture 30 is an abutment surface to engage the terminal block 21 at the proximal end 37 of the cantilever leg 32, and a locking surface 39 is adapted to be engaged by a locking clip 40 at the end of the cantilever leg 32. With this construction, the mounting strip 20 is of a size and dimensions to receive and securely mount a number of the terminal blocks 21.

The metal keeper 11 is of a size and shape to lie contiguous to and oriented with the stack of laminations 18. These are shown as E-I laminations, and in FIG. 1 are shown as being interlaced one by one. The laminations may have another shape, for example, a C-I shape, and may be used for other inductive devices which have a coil. Where E-I laminations are used, they may all be oriented in the same direction or interleaved one, three or five at a time, or arranged as desired. The keeper 11 not only helps orient the stack of laminations but helps hold them together. To this end, the keeper 11 may be secured to the lamination stack 18 in several manners, such as, machine screws through the stack and the keeper, but in this preferred embodiment is shown as being welded. A weld line 41 is shown at the intersection of the E and I laminations at one end of the stack. Another intersection line 42 of the E-I laminations at the other end of the stack has not been shown as being welded in order to illustrate the fact that the E-I laminations are interleaved. However, this intersection line 42 would also normally be welded. A weld line 43 at the edge of the arm 13 at the top of the stack 18 also helps secure together the E-I laminations. A metal mounting plate 44 may be secured, as by welding, to one end of the transformer, and this also helps hold the lamination stack together. The end 45 of the arm 13 is welded at line 46 to the stack again to help secure together the E-I laminations. The end 47 of the middle arm 14 may also be welded to the lamination stack 18. The keeper 11 on the other side of the stack 18 is similarly welded to that side.

The reason for the two mounting strips on the two different keepers is so that connections to the primary winding of the transformer coil 24 may be made at one side of the transformer, and connections to the secondary winding of the transformer coil may be made at the other side. The width of the apertures 30 may be made of any desired width to receive two or more of the terminal blocks. For example, if only two terminal blocks are needed for the primary winding connections 50 and 51 and three terminal blocks are needed for a center tapped secondary winding connection, then the apertures may be made of appropriate width so that after the terminal block is snapped in place, it cannot move, either vertically or horizontally of the mounting strip nor lengthwise along the mounting strip. This snapping in place of the terminal blocks provides for minimization of parts and easy installation.

Thus, FIG. 1 shows a complete transformer 25 utilizing in this case two of the metal keepers 11, although only one may be utilized in any particular transformer. In the drawing of FIG. 1, the actual transformer may have a coil considerably larger than shown. However, it has been made small in this drawing in order to better show the mounts for the terminal blocks.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A combined terminal block mount and lamination stack keeper, comprising, in combination:

a metal keeper having a flat first portion of a size and shape to lie contiguous to and oriented with a stack of laminations;

means for securing said keeper first portion to said lamination stack to aid in securing together the laminations in the stack;

a part of said keeper first portion being adapted to be adjacent an inductance coil on part of a lamination stack;

a bend in said keeper to establish a unitary mounting strip out of a plane defined by the keeper first portion;

an aperture in said keeper adjacent the mounting strip to receive a cantilever leg of one or more terminal blocks; and said mounting strip having a width and thickness to mount a terminal block thereon.

2. A combined terminal block mount and lamination stack keeper as set forth in claim 1, including a second bend in said keeper to establish said unitary mounting strip substantially parallel to said keeper first portion, the aperture being defined between the bends.

3. A combined terminal block mount and lamination stack keeper as set forth in claim 1, including a looking surface on said keeper to receive a locking clip of one or more terminal blocks.

4. A combined terminal block mount and lamination stack keeper as set forth in claim 3, including an abutment surface on the mounting strip at an edge of the aperture defining a part of said aperture and to receive a proximal end of the cantilever arm of one or more terminal blocks.

5. A combined terminal block mount and lamination stack keeper as set forth in claim 1, wherein said keeper first portion has a generally E shape defined by first, second, and third arms to match an E-I lamination stack.

6. A combined terminal block mount and lamination stack keeper as set forth in claim 4, including an edge of said mounting strip adapted to be engaged by a locking clip on a cantilever arm on a terminal block.

7. A combined terminal block mount and lamination stack keeper as set forth in claim 1, wherein a part of the keeper first portion is adapted to be encircled in an inductance coil and is adapted to lie contiguous to a part of a lamination stack.

8. A combined terminal block mount and lamination stack keeper as set forth in claim 1, wherein the aperture is defined by a continuous edge.

9. A combined terminal block mount and lamination stack keeper as set forth in claim 1, wherein the keeper is formed from a piece of flat stock and the aperture is a rectangular aperture formed in the flat stock.

10. A transformer, comprising, in combination:

a stack of laminations;

a combined terminal block mount and lamination keeper having a flat first portion of a metal keeper of a size and shape to lie contiguous to the stack of laminations:

said metal keeper first portion having first, second, and third arms unitary at one end with and perpendicular to a connecting strip;

a transformer coil received on a part of said stack of laminations and on a part of said keeper first portion;

a bend in a portion of said connecting strip to establish a mounting strip out of the plane of the first portion of said metal keeper;

said mounting strip having a given width and thickness to mount a terminal block thereon;

a terminal block having a cantilever arm mounted on said mounting strip; and a connection from said transformer coil to said terminal block.

11. A transformer as set forth in claim 10, including first and second substantially identical keepers on a lamination stack and disposed on opposite sides of the lamination stack.

12. A transformer as set forth in claim 11, including terminal blocks on said first keeper connecting to the transformer coil primary winding and terminal blocks on said second keeper connecting to the transformer coil secondary winding.

13. A transformer as set forth in claim 10, wherein the terminal block has a conductor aperture adjacent to and facing the transformer coil.

14. A transformer as set forth in claim 10, including a mounting plate secured to the lamination stack at an area remote from the mounting strip.

15. A transformer as set forth in claim 10, wherein the first and third arms are secured to the laminations.

16. A transformer as set forth in claim 10, wherein the first and third arms are welded to the laminations.

17. A combined terminal block mount and lamination stack keeper, comprising, in combination:

a metal keeper having a flat first portion defining substantially parallel, spaced first, second, and third arms of a size and shape to lie contiguous to and oriented with a stack of laminations;

means for securing said keeper first portion to said lamination stack to aid in securing together the laminations in the stack;

a part of said keeper first portion being adapted to be adjacent an inductance coil on part of a lamination stack;

a bend in said keeper to establish a unitary mounting strip out of the plane of the keeper first portion; and said mounting strip having a width and thickness to mount a terminal block thereon.

18. A combined terminal block mount and lamination stack keeper as set forth in claim 17, wherein the means for securing include means for securing the first and third arms to the laminations.

19. A combined terminal block mount and lamination stack keeper as set forth in claim 17, wherein said keeper first portion has a generally E shape defined by the first, second, and third arms to match an E-I lamination stack.

20. A combined terminal block mount and lamination stack keeper as set forth in claim 17, including a second bend in said keeper to establish said unitary mounting strip substantially parallel to said keeper first portion.

* * * * *